US006369341B2

(12) United States Patent
Katsumi

(10) Patent No.: US 6,369,341 B2
(45) Date of Patent: Apr. 9, 2002

(54) ELECTRIC SHAVER

(75) Inventor: Muraguchi Katsumi, Tsuna-gun (JP)

(73) Assignee: Sanyo Electric Co., Ltd., Moriguchi (JP)

( * ) Notice: Subject to any disclaimer, the term of this patent is extended or adjusted under 35 U.S.C. 154(b) by 0 days.

(21) Appl. No.: 09/793,503

(22) Filed: Feb. 27, 2001

(30) Foreign Application Priority Data

Feb. 29, 2000 (JP) ..... 2000-054562

(51) Int. Cl.[7] ..... H01H 13/06

(52) U.S. Cl. ..... 200/302.2; 200/293.1; 200/332.2; 200/310

(58) Field of Search ..... 200/520, 293.1, 200/302.1, 302.2, 332.2, 341, 310, 317

(56) References Cited

U.S. PATENT DOCUMENTS 4,471,189 A * 9/1984 Bacon et al. ..... 200/302.2
4,520,247 A * 5/1985 Pancook et al. ..... 200/276
4,825,023 A * 4/1989 Morse ..... 200/302.2
5,258,592 A * 11/1993 Nishikawa et al. ..... 200/302.2
5,939,685 A * 8/1999 Matsuhashi ..... 200/302.1
6,008,460 A * 12/1999 Demari ..... 200/302.2
6,199,998 B1 * 3/2001 Hsiao ..... 362/119

* cited by examiner

*Primary Examiner*—Michael Friedhofer
(74) *Attorney, Agent, or Firm*—Wenderoth, Lind & Ponack, L.L.P.

(57) ABSTRACT

The electric shaver is provided with a push button switch contained in a case, a push button to press the push button switch disposed in the case switch window and switch it on and off, and a waterproof gasket disposed between the push button and the push button switch to seal the case switch window in a watertight configuration. The case has a switch window with a periphery ridge projecting outward from the perimeter edge. The waterproof gasket has an upper surface contact region to contact the periphery ridge upper edge and an inner surface contact region to contact the periphery ridge inside surface. An inner ring is disposed inside the waterproof gasket inner surface contact region to tightly connect the waterproof gasket inner surface contact region and the periphery ridge. The push button is disposed inside the inner ring in a manner allowing it to move in the direction it is pressed.

14 Claims, 8 Drawing Sheets

ELECTRIC SHAVER

This application is based on application No.054562/2000 filed in Japan on Feb. 29, 2000, the content of which incorporated hereinto by reference.

BACKGROUND OF THE INVENTION

This invention relates to an electric shaver which turns on and off with a push button switch, and in particular to an electric shaver in which the push button switch is attached in a watertight configuration.

In an electric shaver provided with a push button switch, switch operation is easier than with a slide switch because the motor can be turned on and off by simply pushing the push button switch. Further, a push button switch has the characteristic that it can be made watertight with a simple structure. This is because a push button switch can be made watertight without parts that move along the case surface as in the slide switch.

FIG. 1 is a cross section view showing the structure of a push button switch with a watertight configuration. In FIG. 1, the push button switch 1019 disposed inside the case 101 is switched on and off with the push button 1020. A switch window 101B in the case 101 is sealed in a watertight fashion with a waterproof gasket 1028 to attach the push button 1020 to the case 101 in a watertight configuration. The waterproof gasket 1028 is provided with an insertion groove 1028A for insertion of a periphery ridge 1024 provided around the periphery edge of the switch window 101B. Further, the outer periphery of the waterproof gasket 1028 is banded to tightly seal the insertion groove 1028A to the periphery ridge 1024 and completely seal the switch window 101B with the waterproof gasket 1028. The push button 1020 is disposed interior to the insertion groove 1028A of the waterproof gasket 1028. In this structure, when the push button 1020 is pushed, the waterproof gasket is distorted and the push button switch 1019 is pressed.

The watertight structure shown in FIG. 1 has the drawback that installation of the waterproof gasket is troublesome. This is because the periphery ridge is inserted into the insertion groove of the waterproof gasket and the unit is banded together in this state with a band around the outer periphery of the waterproof gasket. Further, to make this configuration more completely watertight, it is necessary to increase the height of the periphery ridge for reliable banding of the outer periphery of the waterproof gasket. Therefore, this configuration also has the drawback that the attachment region for the push button becomes thicker. Still further, since the push button is directly connected to the waterproof gasket, it is difficult to move the push button in the direction of pressing while maintaining a fixed stable position. This is because the position of push button moves in the horizontal plane when the waterproof gasket distorts.

The present invention was developed to resolve these types of problems. Thus it is a primary object of the present invention to provide an electric shaver in which the region provided with a push button can be easily assembled and the switch window opened through the case can be reliably sealed in a watertight fashion.

Further, it is another important object of the present invention to provide an electric shaver in which the region comprising the push button can be designed as a thin structure and still be sufficiently watertight, and the push button can be stroked at an accurate position in the direction it is pressed.

The above and further objects and features of the invention will more fully be apparent from the following detailed description with accompanying drawings.

SUMMARY OF THE INVENTION

The electric shaver of the present invention is provided with a push button switch inside the case, a push button to press and switch on and off the push button switch disposed in the switch window of the case, and a waterproof gasket disposed between the push button and the push button switch to seal the case switch window in a watertight configuration. Further, the electric shaver of the present invention is provided with all of the following structures.

The case switch window has a periphery ridge projecting outward from the switch window periphery edge. The waterproof gasket has an upper surface contact region for contact with the upper edge of the periphery ridge, and an inner surface contact region for contact with the inside surface of the periphery ridge. An inner ring is disposed inside the waterproof gasket inner surface contact region to tightly seal the waterproof gasket inner surface contact region with the periphery ridge. The push button is disposed inside the inner ring in a manner allowing the push button to move in the direction it is pushed.

An electric shaver with this configuration has the characteristic that assembly of the region including the push button is simple and the switch window opened through the case can reliably be made watertight. This is because the waterproof gasket is disposed at the periphery ridge provided around the periphery edge of the switch window in the case of this electric shaver. This waterproof gasket has an upper surface contact region for contact with the upper edge of the periphery ridge, an inner surface contact region for contact with the inside surface of the periphery ridge, as well as an inner ring disposed inside the inner surface contact region which tightly seals the waterproof gasket inner surface contact region with the periphery ridge. Further, the push button is disposed within the inner ring in a manner allowing it to move in the direction it is pressed. The region of this configuration of electric shaver provided with the push button can be designed as a thin structure and sufficiently watertight even though assembly is simple and the waterproof gasket is reliably disposed in a fixed position. Further, since the push button of the electric shaver of the present invention moves inside the inner ring, it is characterized by accurate position and a stroke in the direction of pressing.

In the electric shaver of the present invention, the waterproof gasket can be attached in a given location on the case by a surface cover fixed to the case. Further, the inner ring of the electric shaver of the present invention can be attached in a given location on the case by a surface cover fixed to the case.

In the electric shaver of the present invention, the inner ring can be formed as a single piece connected to a cosmetic plate fixed to the surface of the case. Preferably, light windows are provided in this cosmetic plate to shine light outside from lamps installed in the case.

The cosmetic plate of the electric shaver of the present invention can be attached in a fixed position to the case surface in a pressure-fit configuration. Further, the surface cover fixed to the case can press the outer edge of the cosmetic plate to attach the cosmetic plate to a fixed position on the case.

Finally, connection hooks can be provided on the surface cover for connection to the case of the electric shaver of the present invention. In this electric shaver, the connection hooks can be connected with the case to fix the surface cover in a given position on the case.

DETAILED DESCRIPTION OF THE INVENTION

Figure 1:
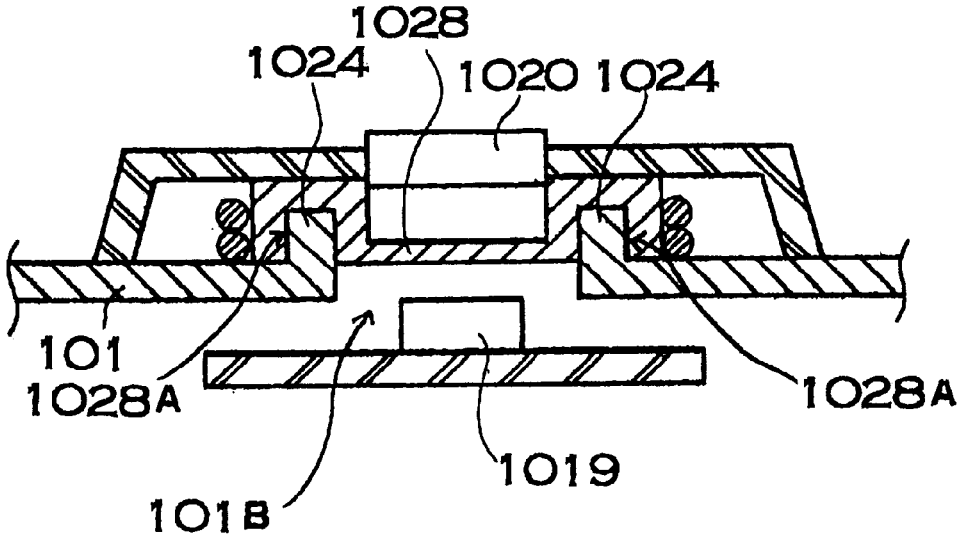
FIG. 1 PRIOR ART
FIG. 1 is a cross-section view showing a prior art push button switch with a watertight structure.
Figure 2:
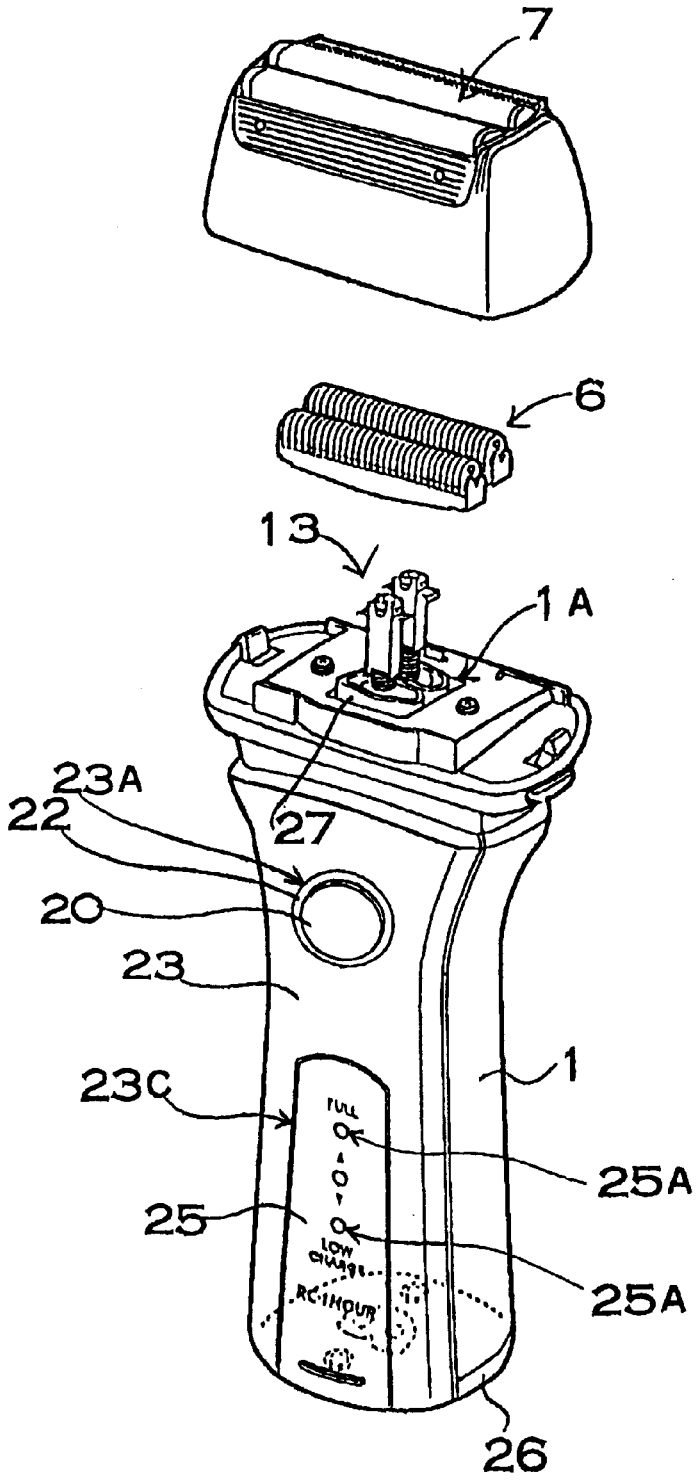
FIG. 2 is an oblique exploded view of an embodiment the electric shaver of the present invention.
Figure 3:
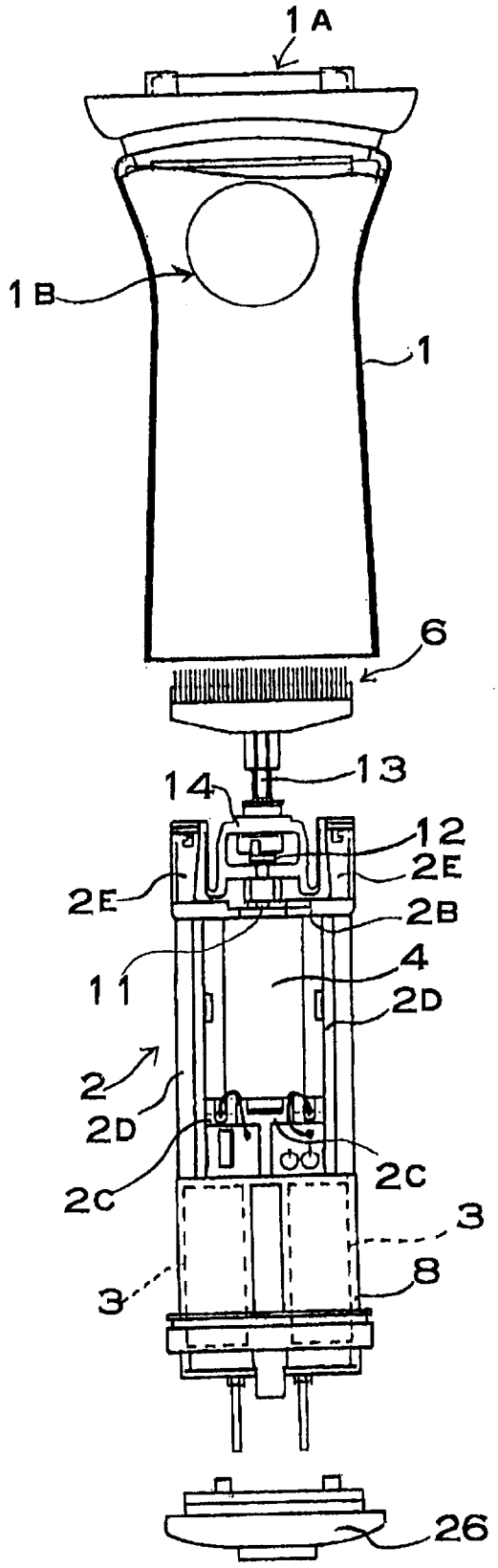
FIG. 3 is a backside view partially exploded and in cross-section of the electric shaver shown in FIG. 2.
Figure 4:
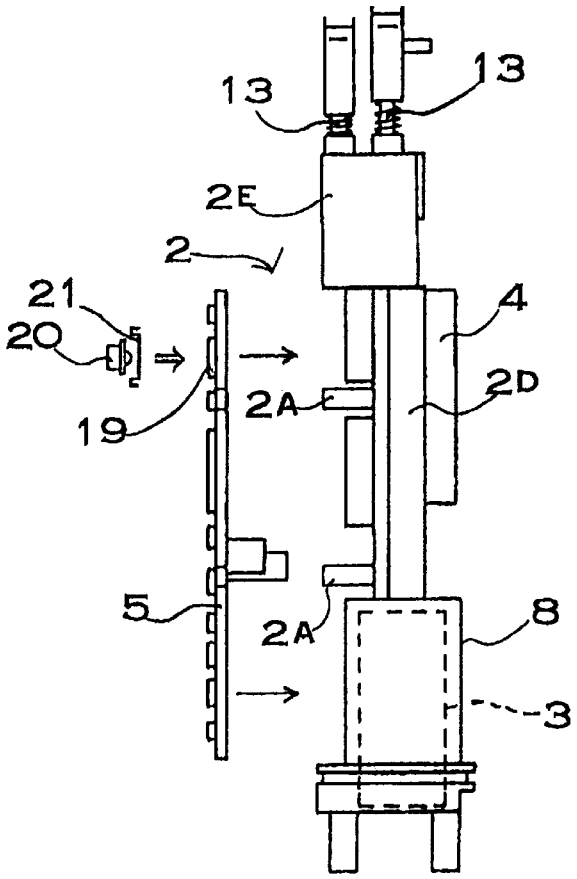
FIG. 4 is a side view of the inner case of the electric shaver shown in FIG. 3.

The electric shaver shown in the oblique view of FIG. 2 has a push button 20 provided in the case 1. The push button 20 operates the push button switch 19 inside the case 1 to switch the internal motor 4 on and off, As shown in FIG. 3, the electric shaver of FIG. 2 is provided with a motor 4 to drive the inner blades 6, batteries 3 to drive the motor 4, an electronic parts attachment board 5 connected to the batteries 3, and an inner holder 2 housed in a fixed position inside the case 1 to hold the electronic parts attachment board 5, the motor 4, and the batteries 3. FIG. 4 shows the inner holder 2 removed from the case 1.

The motor 4 connects to the inner blades 6 via a mechanism which converts rotational motion to reciprocal motion to move the inner blades 6 back and forth. Mechanisms presently in use or any mechanisms developed in the future can be used as the mechanism for conversion to reciprocal motion. For example, a mechanism can be used wherein a cam 12 is fixed to the rotational axis 11 of the motor 4, a vibrating plate 14 which moves back and forth is connected to the cam 12, and the inner blades 6 are attached to the vibrating plate 14. The inner blades 6 vibrate inside outer blades 7, and whiskers insert through innumerable whisker holes provided in the outer blades 7 to be cut, The batteries 3 are rechargeable batteries such as nickel-hydrogen batteries, nickel-cadmium batteries, or lithium-ion rechargeable batteries which attach as a single battery or as a plurality of battery cells in a fixed position on the inner holder 2. The electric shaver of FIG. 3 has two battery 3 cells inserted parallel to each other and contained in inner holder 2 retaining tubes 8.

Figure 5:
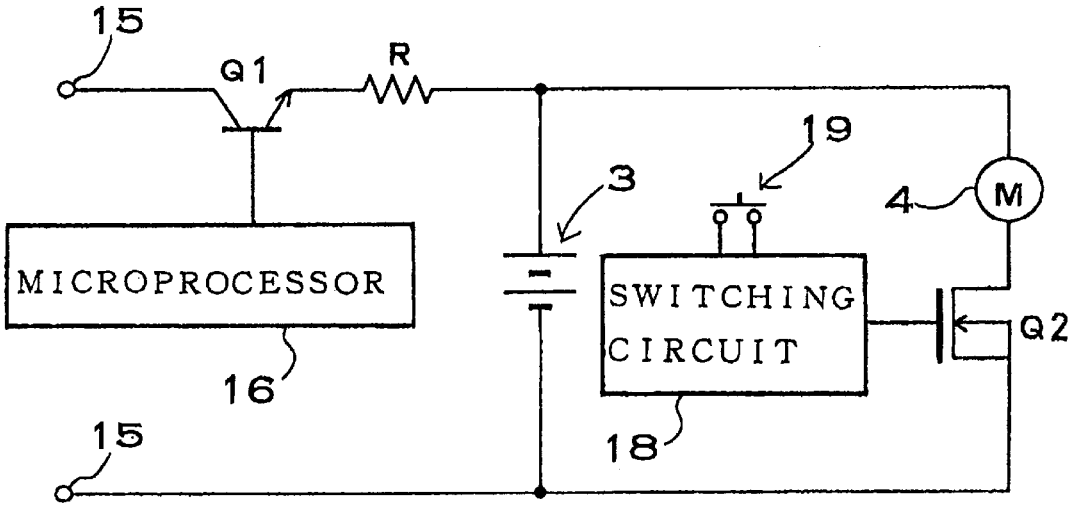
FIG. 5 is a circuit diagram showing the circuit structure for an embodiment the electric shaver of the present invention.

The circuit configuration of the electronic parts attachment board 5 is shown in FIG. 5. An electronic parts attachment board with this configuration contains a circuit to control battery 3 charging and a circuit to control motor 4 rotation. The circuit to control battery 3 charging is provided with a switching device Q1 connected between the batteries 3 and a charging terminal 15, a microprocessor 16 to control the switching device Q1 on and off, and a charging resistor R connected in series between the switching device Q1 and the batteries 3 to limit charging current.

In the charging control circuit, large battery 3 charging currents flow through the switching device Q1 and the charging resistor R. The switching device Q1 emits heat due to electric power proportional to the product of the current and voltage drop, and the charging resistor R emits heat due to electric power proportional to the product of the square of the charging current and the resistance. Since large amounts of heat are produced for large currents, the switching device Q1 and charging resistor R are high power, high temperature devices.

In the battery 3 charging control circuit shown in FIG. 5, the microprocessor 16 computes the remaining battery capacity from battery 3 discharge time. The remaining battery capacity is displayed via LED (not illustrated). Further, the microprocessor 16 computes charging time from the remaining battery capacity and controls the time that switching device Q1 is turned on. When the electric shaver is set in the battery charger, the switching device Q1 turns on and the batteries 3 are charged. The microprocessor determines the time for the batteries 3 to reach full charge, and when the batteries 3 reach full charge, the switching device Q1 is turned off to end charging.

The motor 4 control circuit is provided with a switching device Q2 such as an FET, a switching circuit 18 to turn the switching device Q2 on and off, and a push button switch 19 to input an on and off switching signal to the switching circuit 18. The switching circuit 18 switches its output between high and low to turn the switching device Q2 on or off each time the push button switch 19 is pressed and an ON signal is input. This circuit is characterized by its ability to control the motor 4 on and off using a push button switch of simple structure. Since motor current flows through the switching device Q2 in this circuit, the switching device Q2 emits the most heat. Consequently, the switching device Q2 may be disposed as a high power, high temperature device in a separated section of the inner holder 2. However, since current flow and heating in switching device Q2 are small in comparison with switching device Q1 which controls battery 3 charging, it may also be fixed on the backside of the electronic parts attachment board without disposition as a high power, high temperature device in a separated section.

Figure 7:
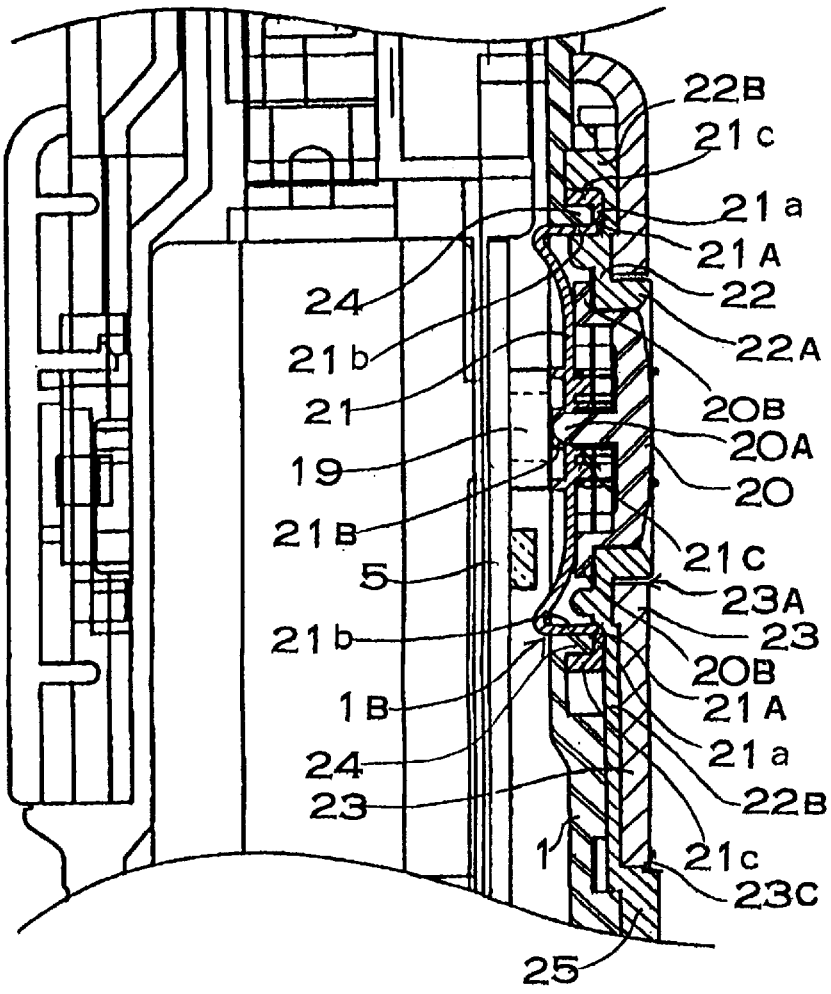
FIG. 7 is an enlarged vertical cross-section view of important elements of the electric shaver shown in FIG. 2.
Figure 8:
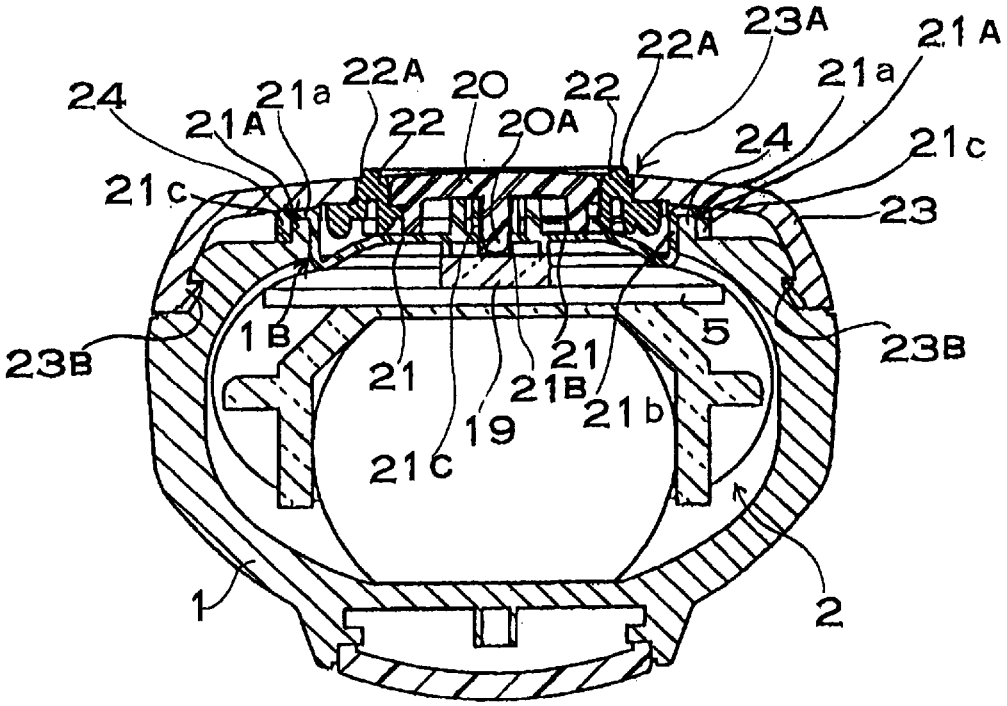
FIG. 8 is a horizontal cross-section view of the electric shaver shown in FIG. 7.

As shown in FIG. 4, the push button switch 19 is fixed to the electronic parts attachment board 5. As shown in the exploded oblique view of FIG. 6, the vertical cross-section view of FIG. 7, and the horizontal cross-section view of FIG. 8, the push button switch 19 is located at a position pressed by the push button 20 provided in the case 1. The push button 20 is attached to the case 1 at switch window 1B in a watertight configuration via a waterproof gasket 21, an inner ring 22, and a surface cover 23.

The push button 20 is formed of plastic in a circular shape with a projection 20A formed as a single piece at the center of the backside for insertion into the waterproof gasket 21. Further, the push button 20 is provided with a retaining flange 20B at the bottom of the periphery edge.

The case 1 is made of plastic and provided with a switch window 1B for disposition of the push button 20. The switch window 1B is circular and is provided with a periphery ridge 24 formed as a single piece along the perimeter of the switch window 1B projecting outward from the case 1. The periphery ridge 24 has a set thickness, its upper edge forms a plane, and it is a vertical wall with the same height overall.

The waterproof gasket 21 is provided with a circular groove 21A to allow insertion of the periphery ridge 24. The waterproof gasket 21 is provided with an upper surface contact region 21 a for contact with the upper edge of the periphery ridge 24, an inner surface contact region 21*b* for contact with the inner surface of the periphery ridge 24, and an outside contact region 21*c* for contact with the outside surface of the periphery ridge 24. As shown in these figures, a structure with provision of a groove 21A in the waterproof gasket 21 and insertion of the periphery ridge 24 in that groove 21A is characterized by simple attachment of the waterproof gasket 21 in a fixed position. However, the waterproof gasket does not necessarily require a groove for insertion of the periphery ridge, and the waterproof gasket may also have a configuration provided with an upper surface contact region for contact with the upper edge of the periphery ridge, an inner surface contact region for contact with the inner surface of the periphery ridge, but no outside contact region.

The waterproof gasket 21 is formed from natural or synthetic rubber, or from a rubber-like elastic material such as flexible plastic. The waterproof gasket 21 of the figures is provided with a projection 21B at the region for pressing the push button switch 19, and on the push button side the waterproof gasket 21 is provided with an insertion cavity 21C to accept the push button 20 projection 20A.

The inner ring 22 is positioned at the inside surface of the inner surface contact region 21*b* of the waterproof gasket 21 and is disposed to tightly seal the inner surface contact region 21*b* of the waterproof gasket 21 with the periphery ridge 24. Further, the push button 20 is disposed inside the inner ring 22 in a manner allowing its movement in the direction of pressing. The inner ring 22 tightly seals the inner surface contact region 21*b* of the waterproof gasket 21 with the periphery ridge 24 to realize a reliable watertight structure. In addition, the push button 20 is disposed within the open region of the inner ring 22 in a manner that allows the push button 20 to stroke smoothly at a fixed location. The inner ring 22 shown in the figures is provided with a surface projection ring 22A which inserts into an opening 23A through the surface cover 23 and is formed as single piece with the inner ring 22.

The inner ring 22 of the figures presses on one part of the waterproof gasket 21 upper surface contact region 21*a*. Further, the inner ring 22 is provided with extensions 22B projecting upwards and downwards for connection to the cosmetic plate 25. The bottom end of the downward extension 22B connects with the cosmetic plate 25. The inner ring 22 shown in the figures is formed entirely of plastic as a single piece with the extensions 22B and cosmetic plate 25. The cosmetic plate 25 has light windows 25A opened through it to shine light outside from lamps such as LEDs installed in the case 1. The cosmetic plate 25 also has flanges 25B provided on both sides. As shown in the cross-section of FIG. 9, the flanges 25B project into the case 1 and interlock with vertical grooves 1C established in the case 1 surface to attach the cosmetic plate 25 to a fixed position on the case 1. In this structure, since the inner ring 22 is formed as a single piece with the cosmetic plate 25, the inner ring 22 is also attached to a fixed position on the case 1 via the cosmetic plate 25. The bottom end of the cosmetic plate 25 extends to the bottom surface of the bottom cover 26, which is fixed to the bottom of the case 1. This prevents separation of the bottom cover 26 from the case 1.

Figure 10:
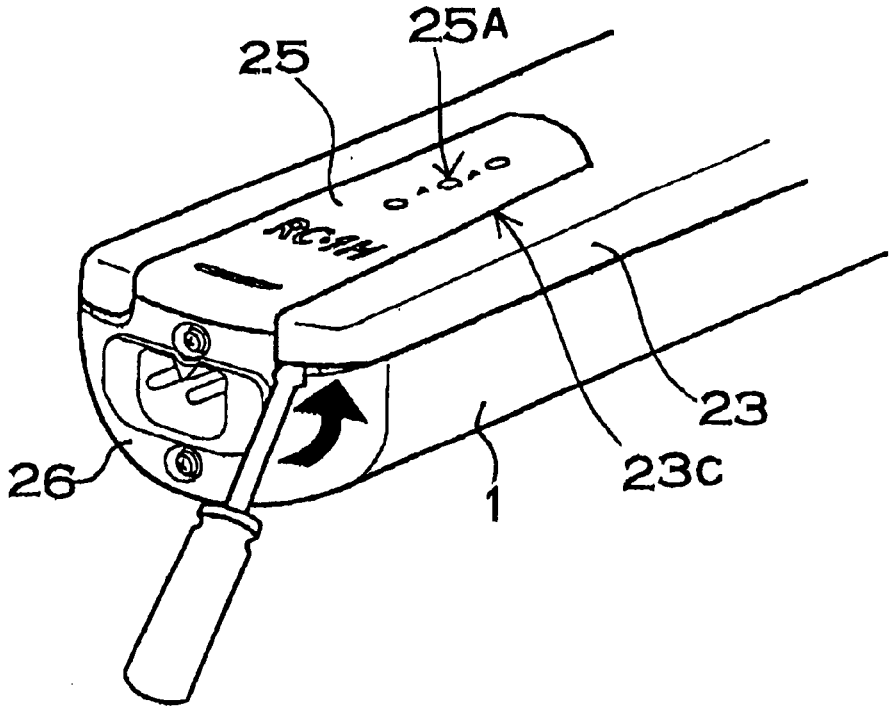
FIG. 10 is an oblique bottom view of the electric shaver shown in FIG. 2.

The surface cover 23 is fixed to the case 1 and attaches the inner ring 22 and the waterproof gasket 21 in fixed locations on the case 1. To fix the surface cover 23 in a fixed position on the case 1, both sides of the surface cover 23 curve along the case 1, and a plurality of connection hooks 23B are formed as a single piece along both edges of the surface cover 23. The case 1 is provided with catches 1D on its sides to mate with these connection hooks 23B. A surface cover 23 of this structure can easily be fixed to the case 1 by snapping the connection hooks 23B into the catches 1D. Further, as shown in FIG. 10, the lower portion of the surface cover 23 extends to the bottom surface of the bottom cover 26, which closes the open region at the bottom end of the case 1. This surface cover 23 is characterized in that it attaches to the case 1 and prevents separation of the bottom cover 26 from the case 1. When removing the bottom cover 26, the lower end of the surface cover 23 is lifted from the case 1 with a tool such as a screwdriver as shown in FIG. 10.

Figure 6:
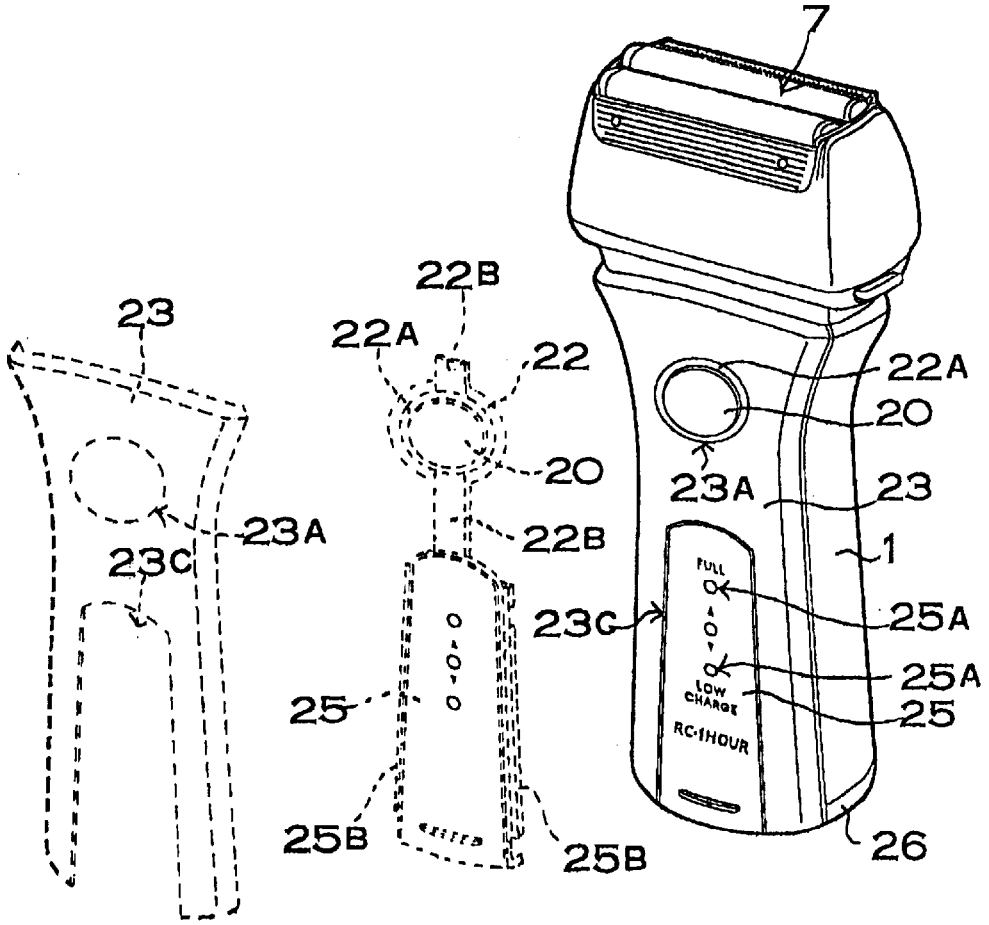
FIG. 6 is an oblique exploded view of the electric shaver shown in FIG. 2.

The surface cover 23 of FIG. 6 has a circular opening 23A to expose the push button 20 and a cut-out 23C to expose the cosmetic plate 25. The inside diameter of the opening 23A is approximately equal to the outside diameter of the surface projection ring 22A of the inner ring 22. The diameter of the opening 23A is smaller than the diameter of the case 1 periphery ridge 24, and the surface cover 23 can push the outside edge of the waterproof gasket 21 towards the case 1 periphery ridge 24. This configuration of surface cover 23 has the characteristic that the upper surface contact region 21*a* of the waterproof gasket 21 can be tightly sealed with the periphery ridge 24 to connect the waterproof gasket 21 to the periphery ridge 24 in a more reliable watertight structure. However, the upper surface contact region of the waterproof gasket can also be pushed towards the periphery ridge and fixed in place by the inner ring.

This inner ring is provided with an outer flange formed as a single piece to press the upper surface contact region of the waterproof gasket onto the periphery ridge. The outer flange is preferably disposed between the waterproof gasket and the surface cover, and presses the waterproof gasket against the periphery ridge. However, the structure may also not fix the inner ring to the case with the surface cover, and not dispose the outer flange between the waterproof gasket and the surface cover. In other words, the inside diameter of the opening through the surface cover can be made larger than the outer flange, and as a structure in which the outer flange is exposed through the surface cover opening, the waterproof gasket can be pressed against the periphery ridge by the outer flange.

Figure 9:
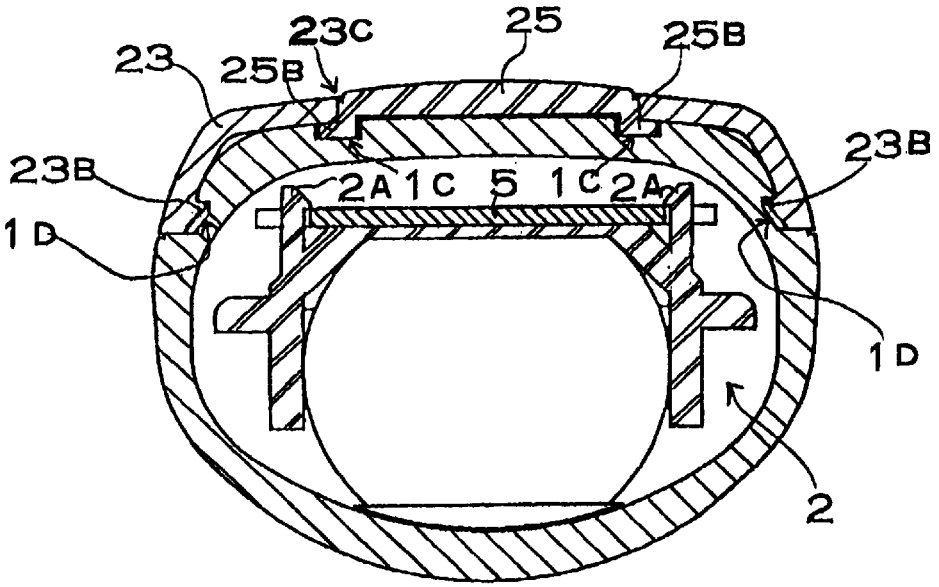
FIG. 9 is a horizontal cross-section view of the lower portion of the electric shaver shown in FIG. 2.

As shown in FIG. 9, the surface cover 23 cut-out 23C presses both sides of the cosmetic plate 25 against the case 1. Namely, with the cosmetic plate 25 flanges 25B interlocked with the case 1 vertical grooves 1C, the surface cover 23 holds the cosmetic plate 25 in a fixed position on the case 1. Consequently, the surface cover 23 cut-out 23C can fit into surface depressions at the flanges 25B provided on both sides of the cosmetic plate 25.

Since the single piece cosmetic plate 25 and inner ring 22, and the surface cover 23 are made as separate parts, an electric shaver with the configuration described above is characterized by the ability to make different parts with different surface colors and produce beautiful color designs. Further, the cosmetic plate 25 and inner ring 22 can be formed as a single piece from plastic while the surface cover 23 can be a metal plate. However, in the electric shaver of the present invention the cosmetic plate 25 and inner ring 22 and surface cover 23 can also be formed as a single piece.

The inner holder 2 is formed as a single piece entirely from plastic. The inner holder 2 shown in FIG. 4 is provided with an attachment surface for attachment of the electronic parts attachment board 5. Retaining clips 2A projecting from both sides of the attachment surface are formed as a single piece with the inner holder 2 to flexibly sandwich and hold both sides of the electronic parts attachment board 5. As shown in the cross-section of FIG. 9, the ends of the retaining clips 2A are formed in the shape of hooks, and these hooks sandwich and retain both sides of the electronic parts attachment board 5. In the inner holder of the figures, two retaining clips are provided on both sides of the inner holder 2, and a total of four retaining clips 2A are provided to sandwich and retain both sides of the electronic parts attachment board 5 at two positions.

The inner holder 2 shown in FIGS. 3 and 4 has retaining tubes 8 for battery 3 insertion formed as a single piece from plastic. The retaining tubes 8 have their upper ends closed off to avoid battery 3 escape through the top of the tubes. The retaining tubes 8 have their lower ends open to allow battery 3 insertion. The inner holder 2 of the figures is provided with two retaining tubes 8 to allow insertion of two circular cylindrical batteries 3 in parallel locations.

Further the inner holder 2 is provided with a horizontal rib 2B in its upper region to hold the motor 4 in a fixed position. An area within the horizontal rib 2B, side walls 2D established on both sides, and a barrier 2C confines the motor 4 to a fixed location.

Still further, the upper ends of the inner holder 2 side walls 2D serve as housings 2E for connection of the inner blade 6 vibrating plate 14, and the ends of the flexible arms of the vibrating plate 14 fit into these housings 2E.

Finally, the case 1 is formed in a cylindrical shape with an open bottom, and the bottom cover 26 is connected in a watertight fashion to the open region at the bottom. The case 1 is provided with a through hole 1A at its upper end, and a vibrating rod 13 projects straight upwards from this through hole 1A. A pliable rubber sheet 27 established between the vibrating rod 13 and the through hole 1A closes off the through hole 1A in a manner that avoids moisture ingress.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within the meets and bounds of the claims or equivalence of such meets and bounds thereof are therefore intended to be embraced by the claims.

What is claimed is:

1. An electric shaver comprising:

(a) a case having a switch window with a periphery ridge projecting outward from a switch window perimeter edge;

(b) a push button switch contained in the case;

(c) a push button to press the push button switch disposed in the case switch window and to switch it on and off;

(d) a waterproof gasket disposed between the push button and the push button switch to seal the case switch window in a watertight configuration; and wherein the waterproof gasket has an upper surface contact region to contact a periphery ridge upper edge and an inner surface contact region to contact the periphery ridge inside surface, an inner ring is disposed inside the waterproof gasket inner surface contact region to tightly connect the waterproof gasket inner surface contact region and a periphery ridge, and the push button is disposed inside the inner ring in a manner allowing it to move in the direction of pressing.

2. An electric shaver as recited in claim 1 wherein the waterproof gasket is attached in a fixed position on the case by a surface cover which is fixed to the case.

3. An electric shaver as recited in claim 1 wherein the inner ring is attached in a fixed position on the case by a surface cover which is fixed to the case.

4. An electric shaver as recited in claim 3 wherein the surface cover has an opening, and a surface projection ring, which is formed as a single piece with the inner ring, is inserted into the opening.

5. An electric shaver as recited in claim 1 wherein the inner ring and a cosmetic plate fixed to the front of the case are connected and have a single piece structure, and the cosmetic plate has light windows to shine light outside from lamps housed in the case.

6. An electric shaver as recited in claim 5 wherein the cosmetic plate attaches to a fixed position on the front of the case via an interlocking structure.

7. An electric shaver as recited in claim 5 wherein a surface cover fixed to the case presses against the outer edges of the cosmetic plate to attach the cosmetic plate in a fixed position on the case.

8. An electric shaver as recited in claim 1 wherein a surface cover has connection hooks for connection to the case, and the connection hooks connect with the case to hold the surface cover in a fixed position on the case.

9. An electric shaver as recited in claim 1 wherein the case is made of plastic and the periphery ridge, which is established along the switch window perimeter edge and projects outward from the case, is formed as a single piece with the case.

10. An electric shaver as recited in claim 1 wherein the periphery ridge has a planar upper edge and is a vertical wall of equal height overall.

11. An electric shaver as recited in claim 1 wherein the waterproof gasket is provided with a groove to allow insertion of the periphery ridge, the upper surface contact region to contact the periphery ridge upper edge, the inner surface contact region to contact the periphery ridge inside surface, and an outer surface contact region to contact a periphery ridge outside surface.

12. An electric shaver as recited in claim 1 wherein the waterproof gasket is formed as a unit of rubber-like flexible material.

13. An electric shaver as recited in claim 1 wherein the waterproof gasket has a projection on a side that presses the push button switch, and the push button switch is pressed with this projection.

14. An electric shaver as recited in claim 1 wherein the push button has a projection which extends outwards towards the waterproof gasket, and the waterproof gasket is provided with an insertion cavity to accept the projection.

* * * * *